United States Patent [19]

Horne

[11] Patent Number: 5,020,721

[45] Date of Patent: Jun. 4, 1991

[54] RAPID RECOVERY GAS HOT WATER HEATER

[75] Inventor: Frank L. Horne, Charlotte, N.C.

[73] Assignee: Gas Fired Products, Charlotte, N.C.

[21] Appl. No.: 409,143

[22] Filed: Sep. 19, 1989

[51] Int. Cl.[5] ..... F23N 1/08

[52] U.S. Cl. ..... 236/20 R; 126/362; 237/19

[58] Field of Search ..... 237/19, 8 R, 8 D, 7; 126/427, 362; 236/20 R, 21 B, 22

[56] References Cited

U.S. PATENT DOCUMENTS

| | | | |
|---|---|---|---|
| 3,659,560 | 6/1972 | Carter . | |
| 3,687,128 | 8/1972 | Williams . | |
| 3,705,574 | 12/1972 | Duncan | 126/362 |
| 4,155,506 | 5/1979 | Brosenius | 126/362 |
| 4,345,583 | 8/1982 | Morin | 126/427 |
| 4,416,256 | 11/1983 | Korwill | 126/427 |
| 4,543,468 | 9/1985 | Shaffer, Jr. et al. | 126/427 |
| 4,594,795 | 6/1986 | Stephansen | 34/156 |
| 4,724,798 | 2/1988 | Alspaugh . | |
| 4,785,792 | 11/1988 | Saint Laurent . | |

*Primary Examiner*—Henry A. Bennett

*Attorney, Agent, or Firm*—Bell, Seltzer, Park and Gibson

[57] ABSTRACT

A rapid recovery gas water heating system having a water storage tank, a gas water heater separate from the storage tank and having a compact heat exchanger for the flow of water therethrough from the storage tank, a water pump for pumping of water from lower regions of the storage tank into and through the heat exchanger and back into the storage tank, and a thermostat having water temperature sensing means positioned in the storage tank and serving for actuating the water pump and the gas water heater in response to the temperature of the water in the storage tank falling below a predetermined temperature value.

5 Claims, 1 Drawing Sheet

RAPID RECOVERY GAS HOT WATER HEATER

This invention relates to water heating systems and more particularly to a rapid recovery gas water heating system which may be used in mobile homes, houses, and other residential and commercial buildings to great advantage.

Currently many mobile homes utilize storage type electrical water heating systems since they do not necessitate any venting to the outside. However, such systems are not as economical to operate as gas fueled systems and frequently cannot supply the quantity of hot water needed.

In Europe and other areas abroad, a quick response water heater has been conventionally used for years. This type of heater is commonly called the "instantaneous" heater in that there is no storage tank and the water is taken directly from the cold inlet supply to a compact heat exchanger and then directly to the point of use. The disadvantage of this type of system is that in some cases it cannot keep up with the demand, with the result that water of an undesirable lower temperature is encountered.

To avoid this problem some instantaneous water heater companies have provided a water storage tank for the heated water from the heat exchanger to flow into. However, the incoming cold water is piped to flow directly into the heat exchanger. This has not proven to present a popular system mainly because the heater is connected to the cold inlet water and does not intake pre-heated water from the tank as hot water is used.

With the foregoing in mind it is the primary object of this invention to provide a gas water heater wherein the desirable features of the "instantaneous" water heater are combined with the more conventional water storage tank heating system used in the United States.

Another object of this invention is to provide a gas water heating system wherein the water storage tank within the home or building, and not the cold water inlet, will serve as the source of water to be heated by an "instantaneous" gas water heater preferably positioned outside the structure if the system is in a mobile home. Thus the gas water heater of this invention may be viewed as a high capacity heater for heating the water in a storage tank.

A further object of this invention is to provide a gas water heating system particularly adapted to be used in mobile homes and to permit the ready conversion of currently installed electrical water heating systems to gas in mobile homes, houses and other buildings.

BRIEF DESCRIPTION OF THE DRAWINGS

Some of the objects of this invention having been stated other objects of the invention will appear as the detailed specification progresses when taken with the accompanying drawings wherein.

DETAILED DESCRIPTION OF THE PREFERRED EMBODIMENT

Figure 1:
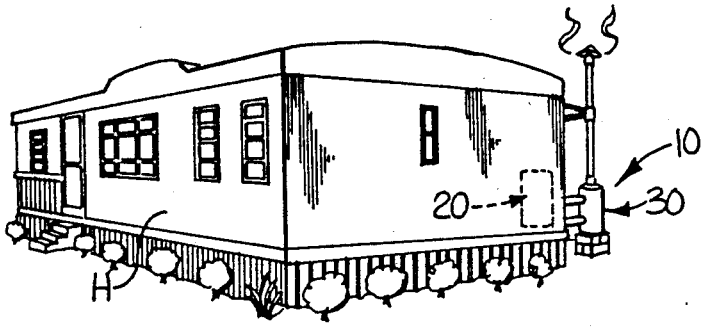
FIG. 1 is a schematic view of a mobile home with the gas water heating system of this invention associated therewith.
Figure 2:
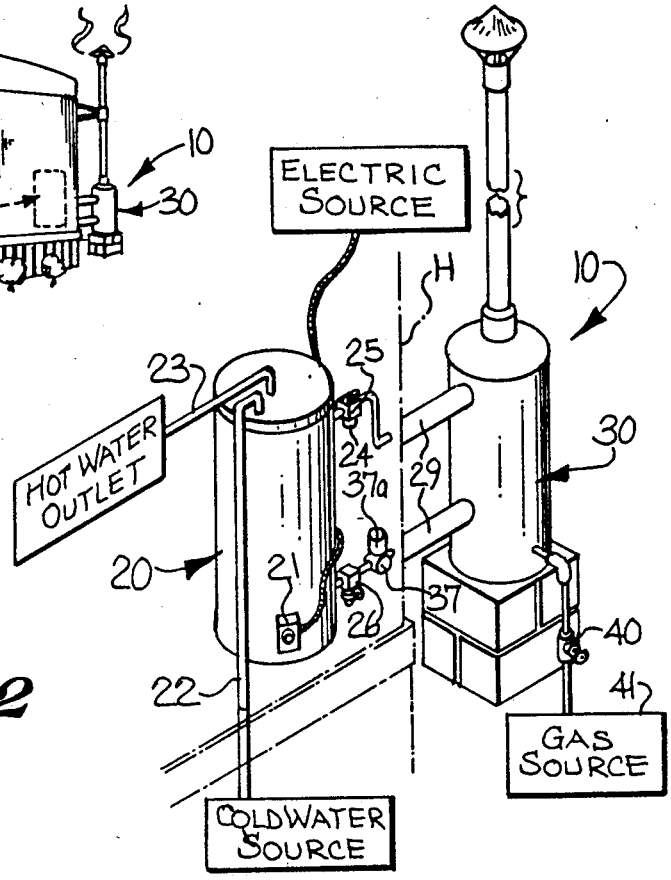
FIG. 2 is an enlarged view of the gas water heating system of FIG. 1.

Referring now specifically to the drawings, reference numeral 10 broadly identifies the overall gas water heating system shown installed in a building, structure, e.g., a mobile home H. The water heating system 10 may be viewed as comprising two main components, namely a water storage tank 20 and a rapid or "instantaneous" heater 30. As illustrated, the storage tank 20 is positioned inside the mobile home H. The heater 30 is adjacent thereto but desirably outside the home to avoid the need for venting through the structure of the building.

The water storage tank 20 is provided with a thermostat 21 having a sensor **21*a* extending into the water within the tank for sensing the temperature thereof and in turn for controlling operation of the heater 30, which will later be described in greater detail. As is conventional, a cold water inlet 22 communicates with lower regions of the tank 20 for replenishing water drawn from the tank 20 through a hot water outlet 23 communicating with upper regions of the tank 20. A safety outlet pipe 24 and associated combination temperature and pressure relief valve 25 is also associated with upper regions of the tank in the event the pressure or temperature in the tank exceeds predetermined safe limits. A drain outlet pipe 26**, is associated with lower regions of the tank to permit draining.

Figure 3:
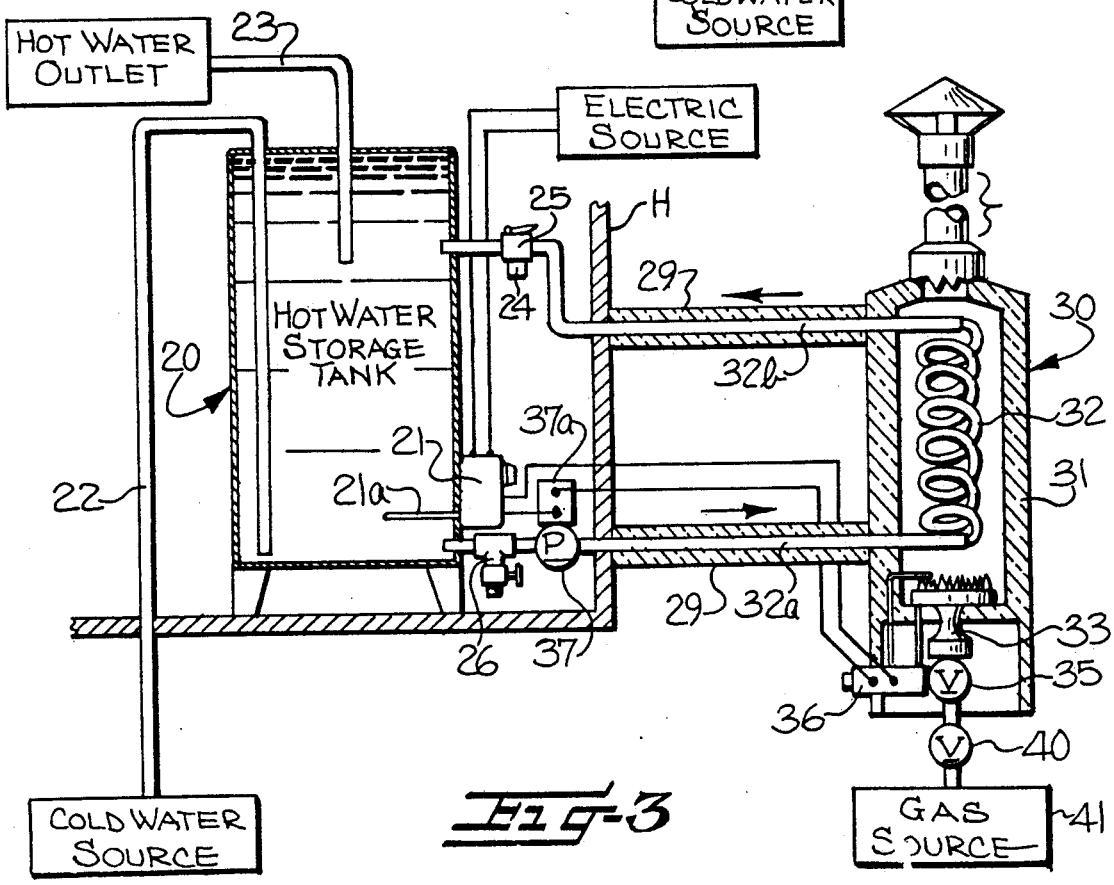
FIG. 3 is a schematic view of the gas water heating system illustrating the various operational components for presenting a workable system.

Referring now to the heater 30, as illustrated a housing 31, preferably insulated, contains a heat exchanger 32 shown in the form of coiled pipe having a lower inlet **32*a* and an upper outlet 32*b*, respectively communicating with lower and upper regions of the water storage tank 20 as best shown in FIG. 3. The inlet 32*a* and outlet 32*b* of the heat exchanger are suitably insulated by surrounding insulation 29. The water capacity of the heat exchanger 32 is only a small fraction of the capacity of the water storage tank 20**.

The heater 30 also has gas burner means 33 provided with a conventional thermocouple 34 of a pilot light or other ignition means. A valve 35 controlled by an associated solenoid 36 is provided electrically connected to the thermostat 21. A pump 37 with an associated motor **37*a* is provided and is actuated in response to the thermostat for pumping water from lower regions of the storage tank 20 into and through the heat exchanger 32. Also the valve 35 is opened when the gas burner means 33 is to be actuated. As is required for safety reasons, a manual cut-off valve 40 is positioned upstream from the solenoid controlled valve 35 for manually interrupting the flow of gas from a supply 41** which may be bottled gas or an underground gas line distribution system.

It will readily be understood from the foregoing description that an electrical water heating system in a mobile home may be converted to gas simply by immobilizing or removing the electrical resistance heaters immersed in the storage tank and connecting a heater 30 in flow communication thereto so that the lower inlet **32*a* of the heater 30 communicates with lower regions of the tank and so that upper outlet 32*b* communicates with upper regions of the water storage tank 20. The provision of the pump 37 in the lower inlet 32*a* and the aforementioned thermostatic controls for actuation of the pump and actuation of the heater 30 essentially complete the conversion. Desirably, as illustrated the heater 30** is positioned outside the home to avoid the need for venting through the structure of the building.

As an illustrative example of the operation of the water heating system, if the temperature of the thermostat 21 is set at 140° F. and hot water is drawn from outlet 23, cold water automatically replaces the drawn off hot water and flows into the tank through inlet 22 and reduces the water temperature to 135° F. The thermostat 21 activates the pump and the gas burner turns on when water flow through the heat exchanger is proven. Water now of 135° F. is pumped into the heat exchanger 32 and returned to the storage tank at approximately 180° F. (a 45° F. rise). With this higher temperature water, the overall tank water temperature will rapidly be restored to its normal setting of 140° F.

That which is claimed is:

1. The combination with a building structure of a rapid recovery water heating system therefor comprising a water storage tank positioned within said building structure and having a cold water inlet communicating with lower regions of the tank and a hot water outlet communicating with upper regions of the tank, a gas water heater separate from said storage tank and mounted outside said building structure and being the sole water heating means for said building, said gas water heater comprising a housing, a heat exchanger for the flow of water therethrough positioned in said housing, said heat exchanger having a water capacity of only a small fraction of the capacity of said water storage tank, said heat exchanger having inlet and outlet ends, said outlet end communicatively connected with upper regions of said storage tank and said inlet end communicatively connected with lower regions of said storage tank, gas burner means positioned adjacent said heat exchanger for heating the water therein, a water pump communicating with said heat exchanger and with said storage tank for pumping of water from lower regions of said storage tank into and through said heat exchanger and back into said storage tank, a thermostat having water temperature sensing means positioned in said storage tank adjacent lower portions thereof, and means operatively connecting said thermostat to said water pump and said gas burner means for actuating both the water pump and said gas burner means in response to the sensed temperature of the water in said storage tank falling below a predetermined temperature value as when heated water in upper regions of the tank is drawn off causing cold inlet water to enter said storage tank.

2. The combination with a mobile home of a rapid recovery water heating system therefor comprising a water storage tank positioned within said mobile home and having a cold water inlet communicating with lower regions of the tank and a hot water outlet communicating with upper regions of the tank, a gas water heater mounted outside said mobile home and being the sole water heating means for said home, said gas water heater comprising a housing, a heat exchanger for the flow of water therethrough positioned in said housing, said heat exchanger having a water capacity of only a small fraction of the capacity of said water storage tank, said heat exchanger having inlet and outlet ends, gas burner means positioned adjacent said heat exchanger for heating the water therein, a water pump communicating with said heat exchanger and with said storage tank for pumping of water from lower regions of said storage tank into and through said heat exchanger and back into said storage tank, a thermostat having water temperature sensing means positioned in said storage tank adjacent lower portions thereof, and means operatively connecting said thermostat to said water pump and said gas burner means for actuating both the water pump and said gas burner means in response to the sensed temperature of the water in said storage tank falling below a predetermined temperature value as when heated water in upper regions of the tank is drawn off.

3. The combination according to claim 2 wherein said water pump means is positioned between said inlet end of said heat exchanger and said storage tank for circulating of water from the storage tank through the heat exchanger.

4. A rapid recovery water heating system according to claim 1 including insulation means associated with the flow of water from said storage tank within said building structure to and through said externally positioned heat exchanger and back to said storage tank.

5. A rapid recovery water heating system according to claim 2, including insulation means associated with the flow of water from said storage tank within said mobile home to and through said externally positioned heat exchanger and back to said storage tank.

* * * * *